United States Patent [19]

Williams

[11] Patent Number: 4,750,219

[45] Date of Patent: Jun. 14, 1988

[54] URINAL DEVICE

[76] Inventor: Douglas A. Williams, 520 W. 114th St., New York, N.Y. 10025

[21] Appl. No.: 546,312

[22] Filed: Oct. 28, 1983

[51] Int. Cl.[4] ..... E03D 13/00; A47K 11/00

[52] U.S. Cl. ..... 4/301; 4/144.1; 4/DIG. 13

[58] Field of Search ..... 4/144.1, 144.3, 301, 4/310, 307, 311, DIG. 13, DIG. 16, DIG. 7

[56] References Cited

U.S. PATENT DOCUMENTS

| | | | |
|---|---|---|---|
| 568,881 | 10/1886 | Simmonds et al. | 4/214 |
| 2,734,198 | 2/1956 | Kutsche | 4/144.2 |
| 2,968,046 | 1/1961 | Duke | 4/144.3 |
| 3,412,408 | 11/1968 | Michal, Jr. | 4/301 |
| 3,533,109 | 10/1970 | Kishimoto | 4/301 |
| 3,742,522 | 7/1973 | Stevenson | 4/311 |
| 3,964,110 | 6/1976 | Kapit | 4/311 |
| 3,964,111 | 6/1976 | Packer | 4/144.4 |
| 4,023,216 | 5/1977 | Li | 4/144.3 |
| 4,121,306 | 10/1978 | Bringman et al. | 4/144.3 X |
| 4,137,579 | 2/1979 | Soler | 4/144.3 X |
| 4,145,768 | 3/1979 | Chevrette | 4/144.1 |
| 4,490,863 | 1/1985 | Pate | 4/301 |

FOREIGN PATENT DOCUMENTS

| | | | |
|---|---|---|---|
| 2839242 | 3/1980 | Fed. Rep. of Germany | 4/144.1 |
| 1063711 | 3/1967 | United Kingdom | 4/DIG. 13 |

*Primary Examiner*—Charles E. Phillips

*Attorney, Agent, or Firm*—Brumbaugh, Graves, Donohue & Raymond

[57] ABSTRACT

A urinal installation includes a urinal bowl, with a flexible conduit member connected to a drainage pipe normally present in bathrooms or the like, and a means to flush the urinal with water. The urinal bowl is mountable on a support such that part of the conduit forms a trap during storage. When lifted from the support for use, the conduit is straightened, removing the trap and permitting drainage. When returned to the support after use, the device is flushed and the trap restored. Alternatively, a portion of the conduit may be a rigid pipe forming a trap regardless of urninal bowl position.

13 Claims, 2 Drawing Sheets

URINAL DEVICE

BACKGROUND OF THE INVENTION

The present invention is a urinal installation which is economic to construct, which may be installed readily in existing plumbing for bathroom fixtures, which is compact in space requirements, and which may be used by persons of either sex.

Domestic water usage accounts for about 10 percent of the total U.S. water usage. Of domestic usage, toilet flushing after urination accounts for 25 to 50 percent. A conventional home toilet uses about 300–600 fluid ounces of water to flush away 6 to 12 ounces of urine. This is wasteful and unnecessary.

Urinals are commonly provided in the men's lavatory facilities of commercial buildings to reduce water usage (as well as for hygienic reasons) but cost and space requirements normally render the addition of a urinal impractical in homes or apartments.

Many cities and communities have plumbing codes which require that the drain pipe of plumbing fixtures, i.e. sinks, toilets, bathtubs, urinals, and so on, which are connected to a vertical drainage pipe, be provided with a trap so as to stop gases in the sewage pipes from traveling back through the fixture into the living area. This requires, in the case of urinals and toilets, that the flushing system be adequate to carry away the wastes and replenish the trap.

SUMMARY OF THE INVENTION

The present invention is a urinal installation in which a urinal device is connected to a vertical drainage pipe, and may be installed in bathrooms together with the conventional toilet. The device is a significant water saver, is simple in construction, and is inexpensive. Unlike conventional urinals and toilets, the invention does not produce sizable bacterial aerosols when flushed.

A urinal bowl has a discharge opening which is connected to a conduit, at least part of which is flexible. The other end of the conduit is connected to an inlet of the waste drainage pipe in a manner to provide a horizontal or downhill flow path from the end of the conduit to the drainage pipe.

A support is provided for detachably mounting the urinal bowl for storage. When mounted to the support, the bowl is at a height such that a portion of the conduit is below the height of the drainage pipe inlet. In this position, the conduit forms a trap to prevent a backflow of gases from the sewage pipes.

In one form of the invention, a rigid U-shaped pipe may be interposed between a flexible conduit member and the drainage pipe inlet. The trap formed by the U-shaped pipe remains present when the device is in use.

In another form of the invention, the conduit is connected directly into the horizontal or vertical waste drainage pipe, for example using a short connecting pipe. When in use, the urinal bowl may be moved to a position in which the trap portion of the conduit is raised at least as high as the drainage pipe inlet, so that liquid in the conduit drains freely.

In a further embodiment of the invention, the conduit is connected to the drain pipe or portion of an existing fixture, such as a sink or toilet. In this embodiment, it is connected downstream of the normally present trap.

Preferably, the urinal bowl is of a lightweight plastic and shaped for use by either sex. The conduit is preferably a flexible plastic tubing. The support may be in the form of a wall-mounted bracket designed so that the urinal bowl may be easily hung and removed.

For a better understanding of the invention, reference is made to the following detailed description of preferred embodiments, taken in conjunction with the drawings accompanying the application.

DETAILED DESCRIPTION OF PREFERRED EMBODIMENTS

Figure 1:
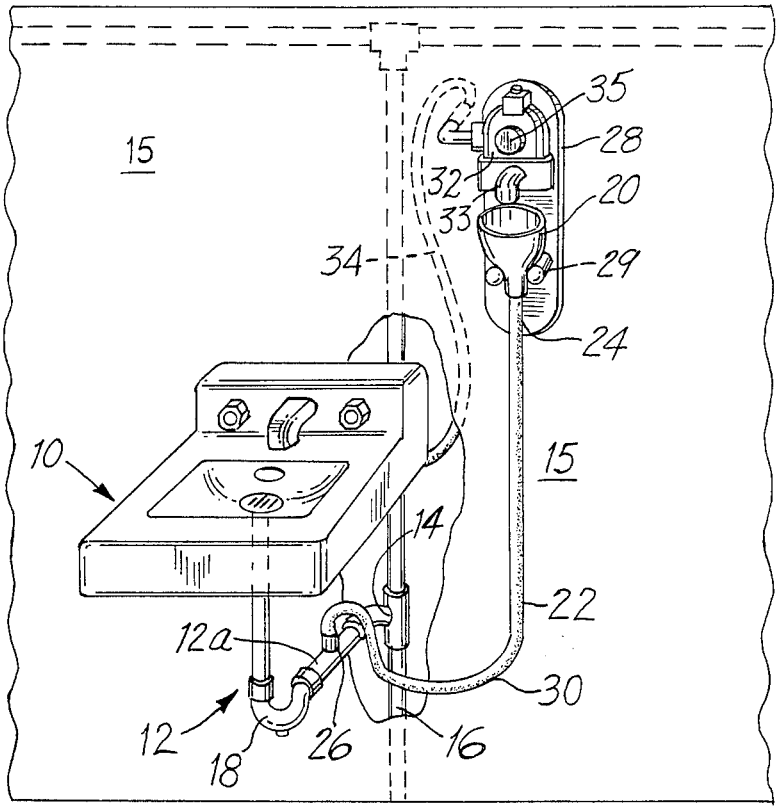
FIG. 1 is a perspective pictorial view of a urinal installation in accordance with the invention.

Referring to FIG. 1, in an existing or new plumbing installation, a sink fixture 10 has a drain pipe 12 connected to an inlet 14 of a vertical drainage pipe 16, which is normally disposed behind an interior wall 15 and is connected to a main sewage pipe (not shown). The drain pipe 12 is provided with a conventional, goose neck, trap 18.

A urinal device includes a urinal bowl 20, which is further illustrated in FIG. 4 and described below. A flexible hose or conduit 22 is connected to a discharge opening 24 in the bottom of the urinal bowl 20, and connects to a fitting 26 in the side or top (as shown) of the horizontal pipe section 12*a* downstream of the trap 18.

A support plate 28 is installed on the wall 15 and includes a pair of supports 29 for holding the urinal bowl 20 in a storage position. The supports 29 may be in the form of a yoke or pegs so that the urinal bowl 20 slips on and off, and is mounted at a distance and height from the fitting 26 so that, when the urinal bowl is so mounted, a portion of the flexible conduit 22 is disposed below the height of the inlet 14 thereby forming a trap 30. At the same time, when the urinal bowl 20 is lifted off the support 29, to a position for use, the trap portion 30 of the conduit 22 is pulled up to or above the height of the inlet 14, so that drainage freely occurs.

As shown in FIG. 1, a flushing valve 32 is mounted on the plate 28 above the supports 29, and has a dispensing outlet 33 arranged to direct water into the bowl 20 when the bowl is resting on the supports 29. The valve 32 is connected to a supply of water by flexible line 34, which may readily be tapped into the sink water supply line.

The flushing valve 32 peferably is of the type which, when actuated, dispenses a metered amount of water. Valves of this type are well known, for example as disclosed in U.S. Pat. No. RE 21,323. The illustrated valve 32 has a push button actuator; however a flush handle or any other suitable actuator may be employed.

Figure 2:
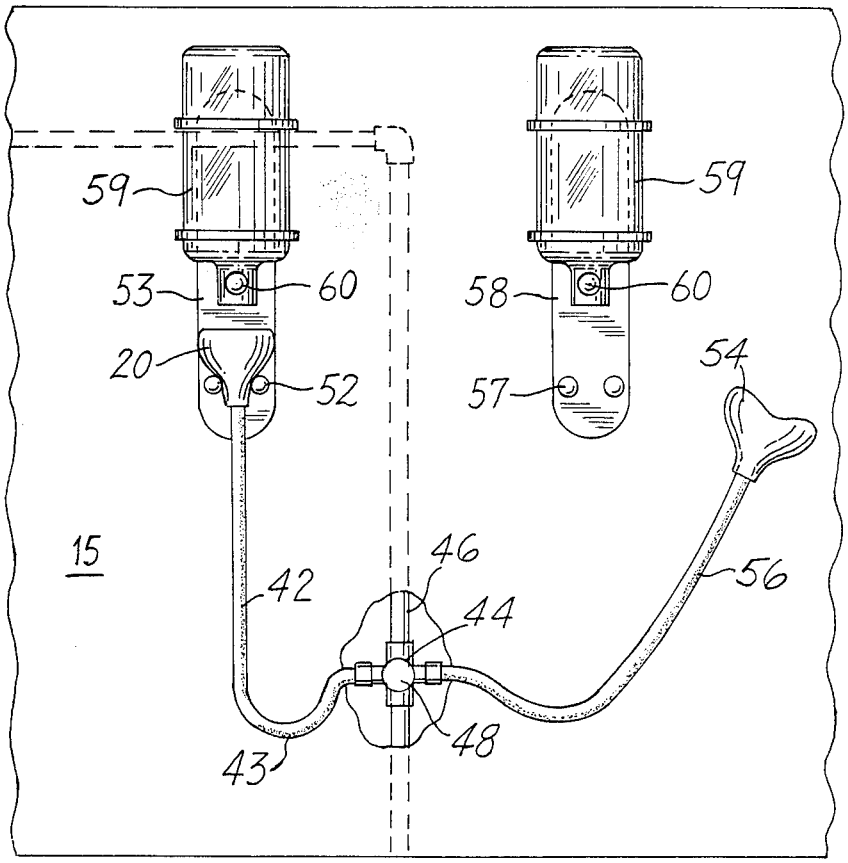
FIG. 2 is a front view of an alternative embodiment of a urinal installation in accordance with the invention.
Figure 4:
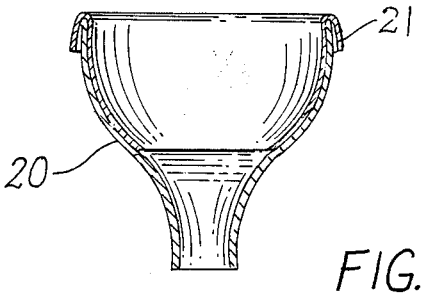
FIG. 4 is a front sectional view of a urinal bowl for use in the installations of FIGS. 1–3.
Figure 5:
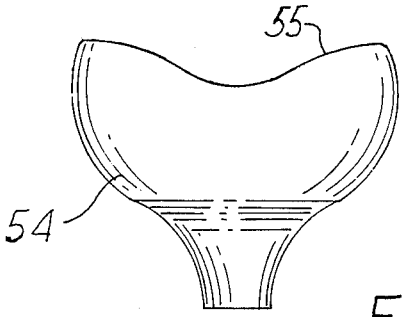
FIGS. 5 and 6 are front and top views, respectively, of a second embodiment of a urinal bowl for use in the installations of FIGS. 1–3.
Figure 6:
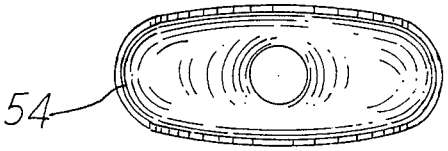

FIG. 2 shows an alternative embodiment of a urinal installation, which contains two urinal bowls 20 and 54, shown in FIGS. 4–6, adapted for use by persons of opposite sex. A flexible conduit 42 is connected directly to an inlet 44 of a vertical drainage pipe 46. Preferably this is done using a short, horizontal connecting pipe 48 to extend through the wall. Urinal bowl 20 is mounted on supports 52 on support plate 53, so that a portion of conduit 42 forms a trap 43. The second urinal bowl 54 and conduit 56 may be connected to a second fitting in pipe 48. Suitable provision is made to prevent reverse discharge from one conduit, e.g. 56, into the other 42.

Alternatively, the conduit 56 may be connected to the vertical drain pipe 46 by a second short section of pipe (not shown), similar to pipe 48. The bowl 54 is shown moved away from its storage position on supports 57, which are mounted on support plate 58, toward its use position. When the conduit 56 is fully extended, fluid in bowl 54 flows downwardly toward the fitting in pipe 48 and the drainage pipe inlet 44.

An alternative to the FIG. 1 flushing arrangement is shown in FIG. 2, wherein a water container or bottle 59 is mounted on each support plate 53, 58, so as to be arranged over the bowls 20, 54. A suitable valve 60 is disposed in the outlet of each bottle 59. The bottles 59 are refillable, and preferably contain a sufficient quantity of water to permit numerous flushes between filling.

In the foregoing embodiments, the outlet end of the conduit 56, 22, or 42 is connected with the drainage pipe inlet 14, 44, so that flow occurs horizontally (or downwardly, if desired). The device is economical to manufacture, may be readily installed in existing plumbing, and requires little space.

Figure 3:
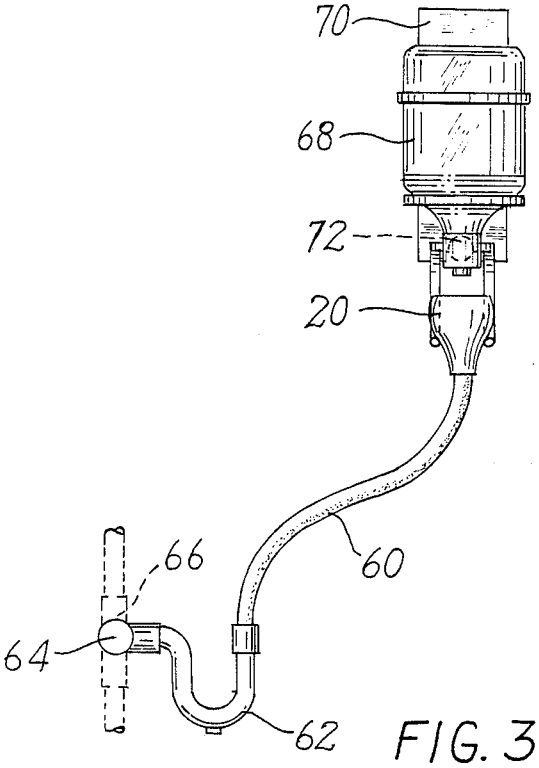
FIG. 3 is a front view of a further embodiment of a urinal installation in accordance with the invention.
Figure 3A:
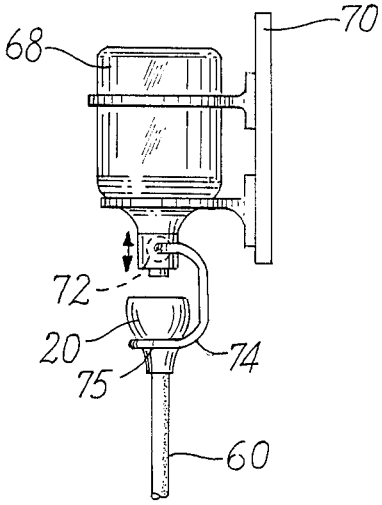
FIG. 3*a* is a side view of a portion of the FIG. 3 urinal installation.

A third installation is shown in FIGS. 3 and 3*a*. A urinal bowl 20 is connected, by a flexible conduit member 60, a rigid U-shaped portion 62, and a section of horizontal pipe 64, to a vertical drain pipe 66. In this embodiment, the trap which is formed by U-shaped portion 62, remains present while the device is used.

A container 68 for dispensing water is mounted on a support plate 70, which may be attached to the wall. A flushing valve 72, disposed in the container opening, is actuated by depressing lever 74 to dispense a predetermined quantity of water. Such valves are known in principle, where movement of the actuating lever in one direction communicates a small chamber with the main supply of liquid to fill the small chamber with a predetermined amount of the liquid, and movement of the lever in the other direction dispenses the predetermined quantity from the chamber.

As shown, the actuating lever 74 is in the shape of a cradle, with a lower portion 75 shaped to support the bowl 20. When the bowl is removed from the cradle, a biasing element moves lever 74 up to refill the dispense chamber. When the bowl 20 is returned to the cradle, the weight of the bowl 20 depresses the lever 74 so as to release the predetermined quantity of liquid and thereby flush the device.

Two preferred shapes of urinal bowls are shown in FIG. 4 and FIGS. 5–6, respectively. The bowl 20, shown in FIG. 4, is substantially round on top and is most suited for use by men. The elongated bowl 54 shown in FIGS. 5–6 has a contoured upper surface 55 which is adapted for use especially by women, but may be used by either sex. Other possible shapes of urinal bowls are shown in U.S. Pat. Nos. 3,412,408, 3,964,110, or 4,023,216.

Referring to FIG. 4, a disposable, protective liner 21 (plastic or paper) may be fitted over the edge of the bowl 20 to extend inside, to protect the user from direct contact with the bowl. A similar protective liner may also be used with the bowl shown in FIGS. 5–6, and shaped accordingly.

The foregoing represents preferred embodiments of the invention. Variations and modifications in the structures shown and described will be apparent to persons skilled in the art, without departing from the inventive concepts disclosed herein. For example, in place of the illustrative flushing systems a water supply may be connected to the urinal bowl, as long as the requisite break is supplied between the supply water and waste water. Also, automatic actuation of the flushing valve, responsive to the return of the bowl to its holder (as employed to FIG. 3), may also be employed in the FIG. 1 flushing system, using any weight-sensitive, optical, or other suitable detection device. This invention may be installed on airplanes, buses, trains, ships moving in certain water areas, and other conveyances subject to gravitational forces, where such installation would greatly reduce the volume and storage thereof of flushed material. All such modifications and variations are intended to be within the scope of the invention as defined in the following claims.

I claim:

1. A urinal installation comprising a vertical drainage pipe having an inlet and a urinal device connected thereto, wherein said urinal device comprises: a urinal bowl having a discharge opening in the bottom thereof; a conduit means having one end connected to said opening, wherein at least part of said conduit means is flexible; means for connecting the other end of said conduit means to said inlet, wherein the connecting means is arranged to support said other end, and to provide a low path between said other end and said drainage pipe, at least at the same height as said drainage pipe inlet; and support means for detachably mounting said urinal bowl at a height such that a portion of said conduit means is below the height of said inlet to form a trap, wherein said trap is formed by a flexible portion of said conduit means, and wherein said urinal bowl may be removed from said support means to a position in which said portion is at least at the same height as said drainage pipe inlet.

2. A urinal installation as defined in claim 1, wherein said connecting means includes a horizontal pipe section communicating with said inlet.

3. A urinal instllation as defined in claim 2, wherein said pipe section includes a trap and is connected to or contained in a fixture, said conduit means being connected to said pipe section downstream of said trap.

4. A urinal installation as defined in claim 1, further comprising a water dispensing means, and means for mounting said water dispensing means to said support means for dispensing water into said urinal bowl when the urinal bowl is mounted to said support means.

5. A urinal installation as defined in claim 4, wherein said water dispensing means comprises actuation means, and means for dispensing a predetermined amount of water responsive to the actuation of said actuation means.

6. A urinal installation as defined in claim 5, wherein said actuation means is coupled to said support means, and is automatically responsive to the placing of said urinal bowl on said support means.

7. A urinal installation as defined in claim 1, wherein said urinal bowl has an upper edge, and further comprising a disposable, protective liner fitted over said upper edge and extending inside said bowl to protect the user from contact with said bowl.

8. A urinal installation as defined in claim 7, wherein said liner is made of plastic.

9. A urinal installation as defined in claim 7, wherein said liner is made of paper.

10. A method of constructing a urinal installation and of connecting said installation to a plumbing fixture having a connecting pipe, including a trap, for connecting the fixture to a vertical drainage pipe, comprising the steps of:

forming an inlet in said connecting pipe downstream of said trap;

connecting one end of a conduit means to said inlet, wherein at least a part of said conduit means is flexible;

connecting the other end of said conduit means to a urinal bowl; and providing a support means for detachably mounting said urinal bowl at a height where a portion of said conduit means is below the height of said inlet to form a trap, wherein said trap is formed by a flexible portion of said conduit means, and wherein said urinal bowl may be removed from said support means to a position in which said portion is at least at the same height as said drainage pipe inlet.

11. A method as defined in claim 10, comprising the step further of providing a water dispensing means on said support means for dispensing water into said urinal bowl when the urinal bowl is mounted on the support means.

12. A method of constructing a urinal installation and connecting said installation to a plumbing fixture having an integral trap, such as a conventional toilet, comprising the steps of:

forming an inlet in said fixture downstream of said integral trap;

connecting one end of a conduit means to said inlet, wherein at least a part of said conduit means is flexible;

connecting the other end of said conduit means to a urinal bowl; and providing a support means for detachably mounting said urinal bowl at a height where a portion of said conduit means is below the height of said inlet to form a trap, wherein said trap is formed by a flexible portion of said conduit means, and wherein said urinal bowl may be removed from said support means to a position in which said portion is at least at the same height as said drainage pipe inlet.

13. A method as defined in claim 12, comprising the step further of providing a water dispensing means on said support means for dispensing water into said urinal bowl when the urinal bowl is mounted on the support means.

* * * * *

UNITED STATES PATENT AND TRADEMARK OFFICE

CERTIFICATE OF CORRECTION

PATENT NO. : 4,750,219

DATED : June 14, 1988

INVENTOR(S) : Douglas A. Williams

It is certified that error appears in the above-identified patent and that said Letters Patent is hereby corrected as shown below:

Column 4, line 33, "low" should be --flow--.

Signed and Sealed this

Twenty-second Day of November, 1988

*Attest:*

DONALD J. QUIGG

*Attesting Officer*

*Commissioner of Patents and Trademarks*